United States Patent [19]

Schuster

[11] Patent Number: 4,905,889

[45] Date of Patent: Mar. 6, 1990

[54] PACKAGING TRAY

[75] Inventor: Richard L. Schuster, Monroe, La.

[73] Assignee: Manville Corporation, Denver, Colo.

[21] Appl. No.: 303,793

[22] Filed: Jan. 30, 1989

[51] Int. Cl.[4] ..... B65D 5/20

[52] U.S. Cl. ..... 229/120.17; 206/561

[58] Field of Search ..... 229/120.17; 206/561

[56] References Cited

U.S. PATENT DOCUMENTS

| | | | |
|---|---|---|---|
| 1,465,231 | 8/1923 | Oglesby | 229/120.17 |
| 1,757,475 | 5/1930 | Pratt | 206/561 |
| 1,927,321 | 9/1933 | O'Reilly | 229/120.17 |
| 2,000,738 | 5/1935 | Benoit | 229/120.17 |
| 2,058,638 | 10/1936 | Shapiro | 229/120.17 |
| 2,743,050 | 4/1956 | Crane | 229/120.17 |
| 2,934,252 | 4/1960 | Wickstrom | 229/120.17 |
| 3,009,622 | 11/1961 | Leone | 229/120.17 |
| 3,084,790 | 4/1963 | Vander Lugt, Jr. | 229/120.17 |
| 4,192,443 | 3/1980 | McLaren | 229/120.17 |

*Primary Examiner*—Stephen Marcus
*Assistant Examiner*—K. M. Stemann
*Attorney, Agent, or Firm*—John D. Lister

[57] ABSTRACT

A paperboard tray for holding spaced rows of flat articles. A divider separating the rows includes sloped walls which, along with sloped wall portions in the side panels of the tray, serve to support the articles. A web connecting an outer end flap to a divider wall acts as a stop member to automatically position the end of the inner end flap as the overlapping flaps are moved into position during the formation of the tray from a blank.

11 Claims, 3 Drawing Sheets

PACKAGING TRAY

FIELD OF THE INVENTION

This invention relates to a packaging tray which includes a divider for separating rows of articles. More particularly, it relates to a packaging tray of this type adapted to be formed from a paperboard blank.

BACKGROUND OF THE INVENTION

In the packaging of fragile food products, such as cookies, molded plastic trays incorporated in an outer bag have been used to support the cookies. The trays typically contain a center divider spaced from the side panels. Both the dividers and the side panels have sloped walls which form channels or troughs on either side of the divider in which rows of cookies are supported.

Such trays have a number of drawbacks. Although the plastic molding operation allows them to readily take any desired shape, the trays have to be shipped in molded form to the packaging plant. Even when nested, the number of trays which can be shipped in a truckload is limited, resulting on overall higher shipping costs than desired. In addition, the cost of the resin used in forming the trays has increased significantly and can be expected to continue to increase, which will make the use of plastic trays impractical from a cost standpoint at some point in the future. Separate from cost considerations is the threat of legislation against the packaging of food products in certain types of plastics due to the possible absorption into the food of gases released from the plastic material.

It would be highly desirable to be able to substitute paperboard trays for the plastic trays now in use in order to overcome the possible health threat and to reduce the cost of the trays. Ideally, such trays would be formed from paperboard blanks capable of being shipped to the packaging location in flat condition, which would enable a great many more trays to be produced from a single truckload. The problem, however, is to design a paperboard tray which can be readily and rapidly formed from a single flat sheet of minimal size and which has the desired final shape.

SUMMARY OF THE INVENTION

In accordance with the invention, a paperboard tray is provided which is comprised of spaced bottom panel portions connected by fold lines to end panels, to side panels and to divider means. Sloped walls of the divider means form obtuse angles with the bottom planel portions. The portions of the tray between the divider means and the side panels comprises channel means adapted to receive and support rows of articles. Preferably, the side panels also contain sloped wall portions so that the sloped walls of both the divider means and the side panels are adapted to support substantially flat rounded-edge articles such as cookies.

To enable a tray to be formed from a flat blank the end panels are comprised of overlapping flaps which are connected to the bottom panel sections by fold lines but which are basically unconnected to the divider walls. This allows the divider walls to be folded into place without interference from the end flaps. At one location, however, means are provided between a portion of a divider wall and an outer end panel flap to properly position the inner flap to allow the divider walls to be folded up to form the divider. In a preferred embodiment such means takes the form of a web which extends from an adjacent end edge of an adjacent divider wall into the outer end flap. By connecting the web to the divider wall along one fold line and to the outer end flap along a second fold line, the end flaps are automatically placed in proper relative positions during the forming of the tray from the blank. This enables the tray to be quickly and accurately formed even though a divider must be created during the folding process from connected portions of the blank.

The blank is inexpensive yet capable of being readily formed into a tray of the desired shape and dimensions.

Other features and aspects of the invention, as well as other benefits thereof, will readily be ascertained from the more detailed description of the invention which follows.

DESCRIPTION OF THE PREFERRED EMBODIMENT

Figure 1:
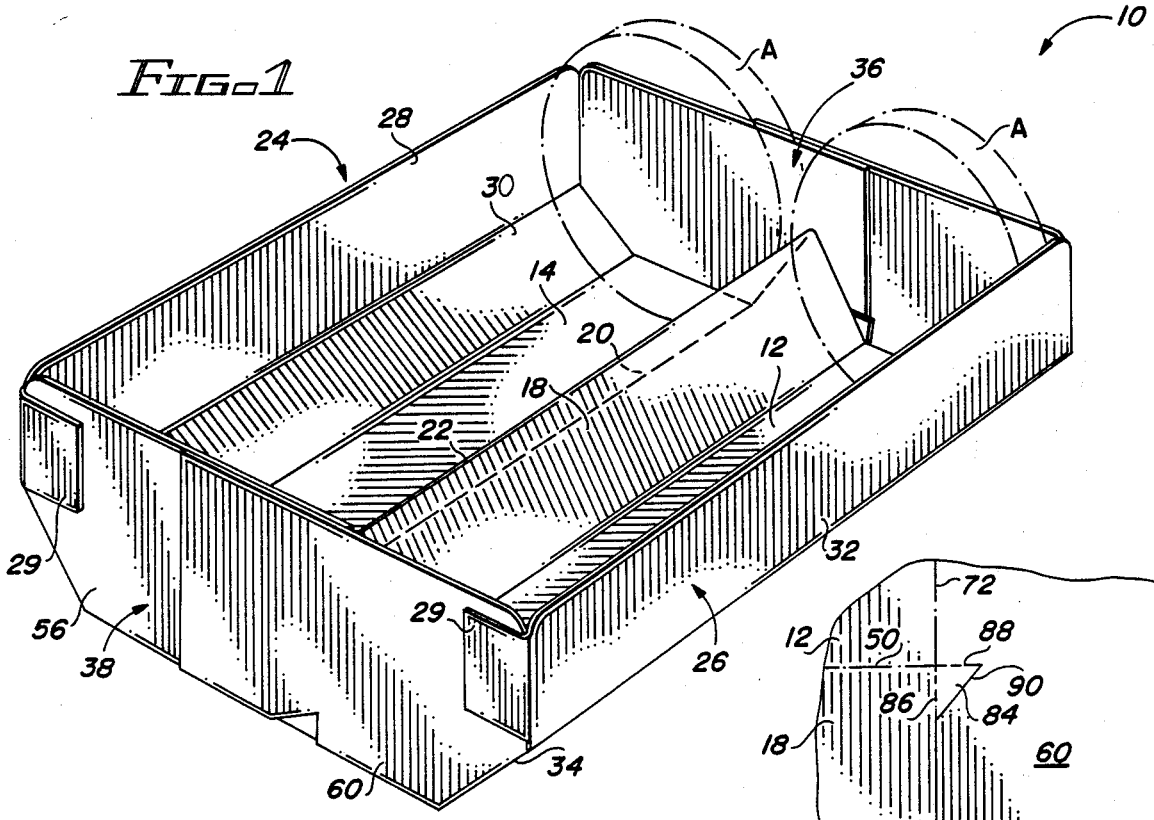
FIG. 1 is a pictorial view of the packaging tray of the invention.

Referring to FIG. 1, the packaging tray 10 of the present invention comprises bottom panel portions 12 and 14 separated by a center divider 16. The center divider comprises sloping walls 18 and 20 connected at their uppermost point along a fold line 22 which extends parallel to the side panels 24 and 26. The side panel 24 consists of an upper vertical portion 28 and a lower sloped portion 30. Similarly, the side panel 26 consists of an upper vertical portion 32 and a lower sloped portion 34. Although the final shape and dimensions of the tray are dependent upon the shape and size of the articles to be packaged, in many cases the angle formed by the sloped side panel portions 30 and 34 with the adjacent bottom panel portions 14 and 12 will be the same as the angle formed by the sloped walls 20 and 18 with the bottom panel portions. Thus fragile articles such as cookies A, illustrated in FIG. 1 in dotted outline, will be supported along their circumference just below their midpoint by the sloped walls of the side panels and divider. If desired, the dimensions may be made so that the cookies are also supported at their lowermost edges by the bottom panels. Completing the construction of the tray 10 are end panels 36 and 38. Additional details of the tray construction will be discussed later.

Figure 2:
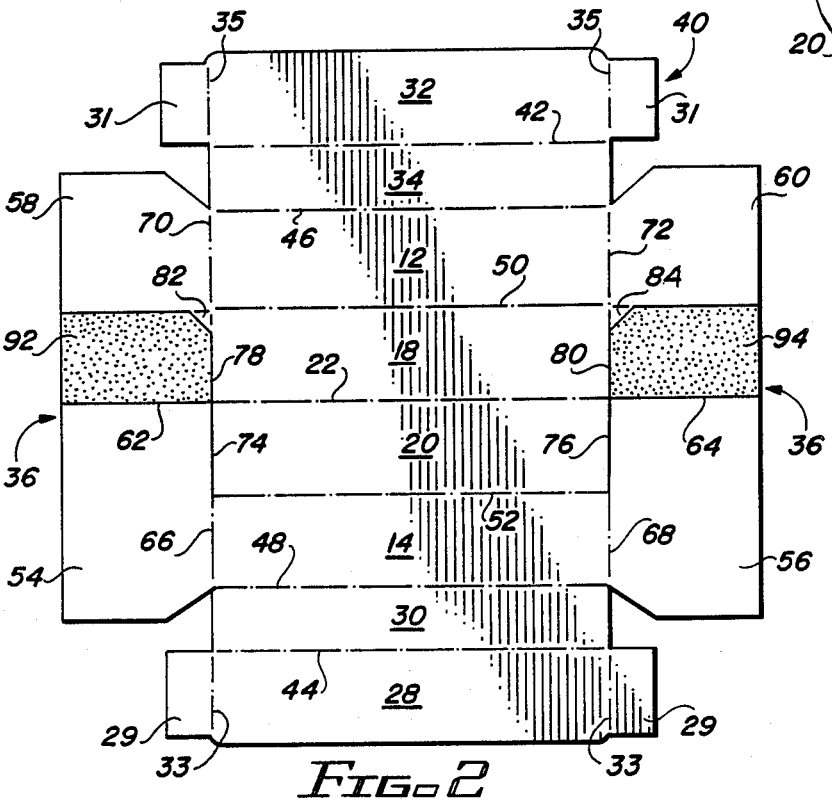
FIG. 2 is a plan view of the inside surface of a blank for forming the tray of FIG. 1.

Referring now to FIG. 2, a blank 40 to be used in forming the tray of FIG. 1 has various sections identified by reference numerals corresponding to those employed in identifying the elements of the tray. Side panel section 32, which becomes the vertical panel portion in the erected tray, is connected by fold line 42 to side panel section 34, which becomes the sloped wall portion in the erected tray. A similar arrangement exists at the opposite end of the blank wherein side panel sections 28 and 30 are connected to each other by fold line 44. The blank side panel sections 34 and 30 are connected by fold lines 46 and 48, respectively, to bottom panel sections 12 and 14, which in turn are connected by fold lines 50 and 52, respectively, to the divider wall sections 18 and 20. The divider wall sections are connected together along fold line 22. The ends of the side panel sections 28 and 32 are connected to glue tabs 29 and 31, respectively, by fold lines 33 and 35.

Still referring to FIG. 2, the end panel sections 36 and 38 are comprised of separate flaps intended to overlap each other in the tray. Thus inner flaps 54 and 56 are separated from outer flaps 58 and 60, respectively, by slits 62 and 64 which are aligned with the fold line 22. Inner flaps 54 and 56 are connected to the bottom panel section 14 along end fold lines 66 and 68, respectively, and outer flaps 58 and 60 are connected to the bottom panel section 12 along end fold lines 70 and 72, respectively. The inner end panel flaps 54 and 56 are not connected to the adjacent divider wall portion 20, but instead are separated from it by slits 74 and 76. In like manner the outer end panel flaps 58 and 60 are separated from the adjacent divider wall portion 18 by slits 78 and 80. The slits 78 and 80, however, do not extend along the entire width of the divider wall section 18 as the slits 74 and 76 do in connection with divider wall section 20. Instead, divider wall section 18 is connected adjacent one corner to the flaps 58 and 60 by webs 82 and 84.

Figure 3:
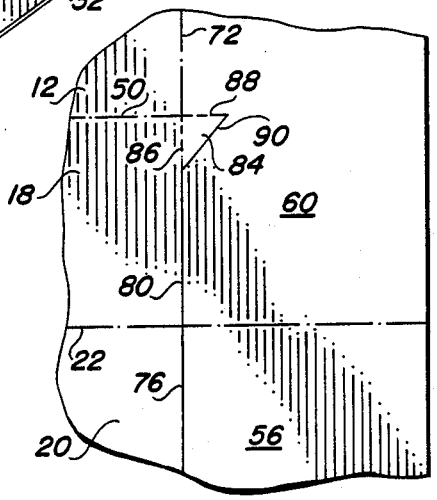
FIG. 3 is an enlarged plan view of a portion of the blank of FIG. 2.

As shown more clearly in FIG. 3, which is an enlarged view of the portion of the blank containing the web 84, it will be seen that the web is connected to the divider panel section 18 by fold line 86 and to the outer end panel flap 60 by the fold line 88. The web is separated from the flap 60 between the fold lines 86 and 88 by the connecting slit 90.

Figure 4:
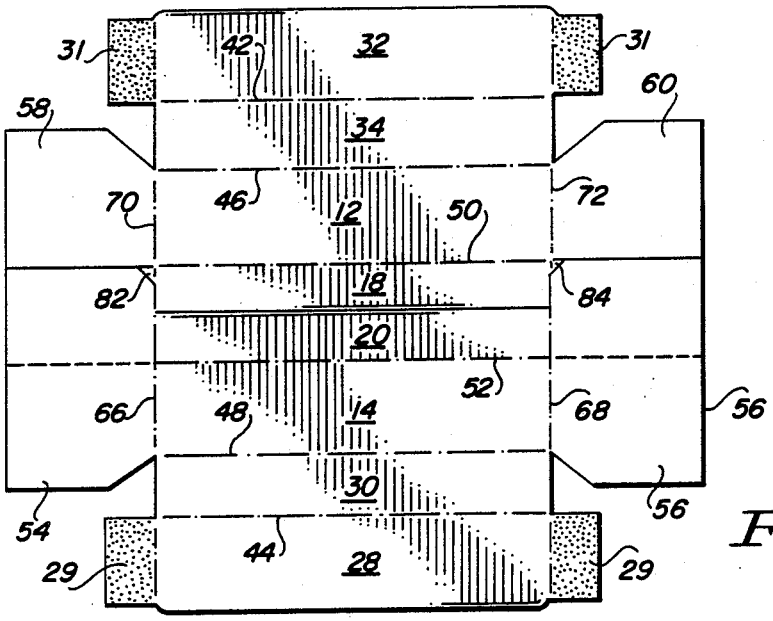
FIG. 4 is a plan view of the blank of FIG. 2 after it has been subjected to an initial folding step.

Referring back to FIG. 2, the first step in forming a tray from the blank 40 is to apply adhesive to the stippled areas 92 and 94 of the outer end panel flaps 58 and 60, the stippled areas extending from the edges of the flaps at slits 62 and 64 to a point aligned with the fold line 50. Then the side panel sections 28 and 32 are moved toward each other so that the divider walls 18 and 20 fold up about the fold lines 50 and 52, causing the inner end flaps 54, 56 and the outer end flaps 58, 60 to move toward each other due to their being connected to the bottom panel sections 12 and 14. The inner end flaps 54 and 56 as a result slide over the stippled area 92 and 94 of outer end flaps 58 and 60 until they reach the position shown in FIG. 4. In this position the interior edges of the inner end panel flaps 54 and 56 are substantially aligned with the fold line 50 and the interior edges of the outer flaps 58 and 60, shown in dotted lines, are substantially aligned with the fold line 52.

Figure 5A:
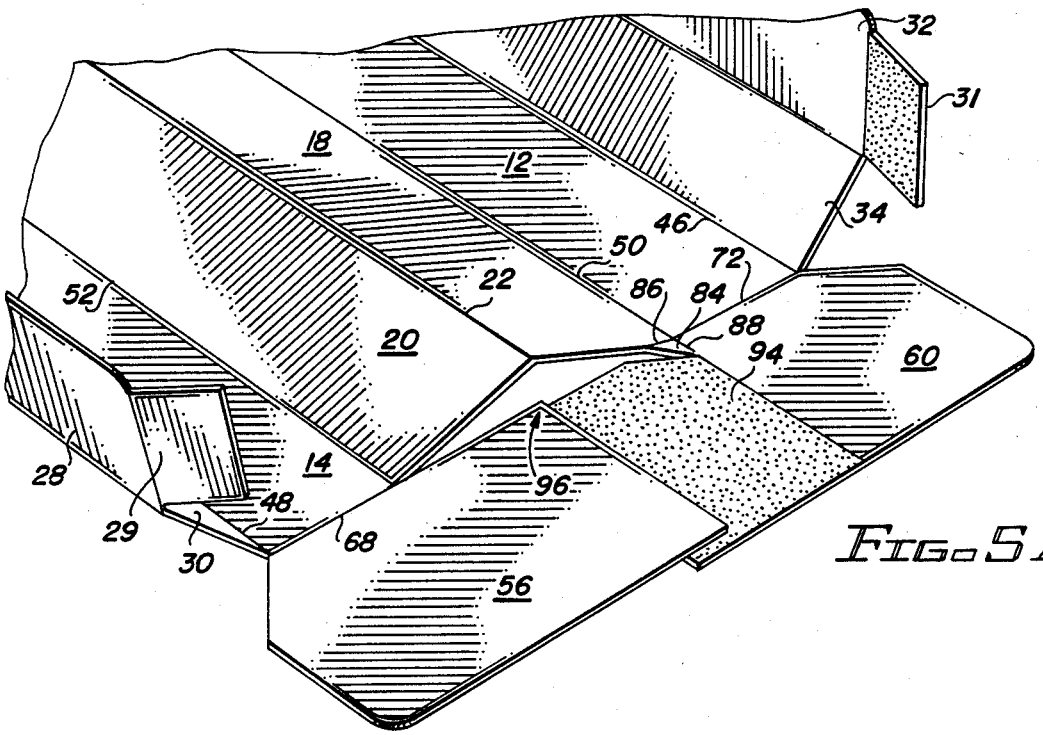
FIG. 5A is an enlarged pictorial view of a portion of the blank of FIG. 2 during the initial folding step.

This action is illustrated more clearly in FIG. 5A, which shows the blank at an intermediate stage of the relative sliding movement between the flaps 56 and 60. The upward bending of the divider wall sections 18 and 20 about the fold lines 50 and 52 and the resulting relative downward folding movement of the sections 18 and 20 about central fold line 22 can be seen. Because the web 84 is attached to the divider wall section 18 by fold line 86, upward movement of the section 18 lifts the web 84 out of the plane of the end flap 60. By this action the web folds upwardly about the fold line 88, causing the edges forming the slit 90 to separate. The separation of these edges and the connection of the web 84 at fold line 88 form a pocket into which the leading interior corner area 96 of the inner flap 56 can move.

Figure 5B:
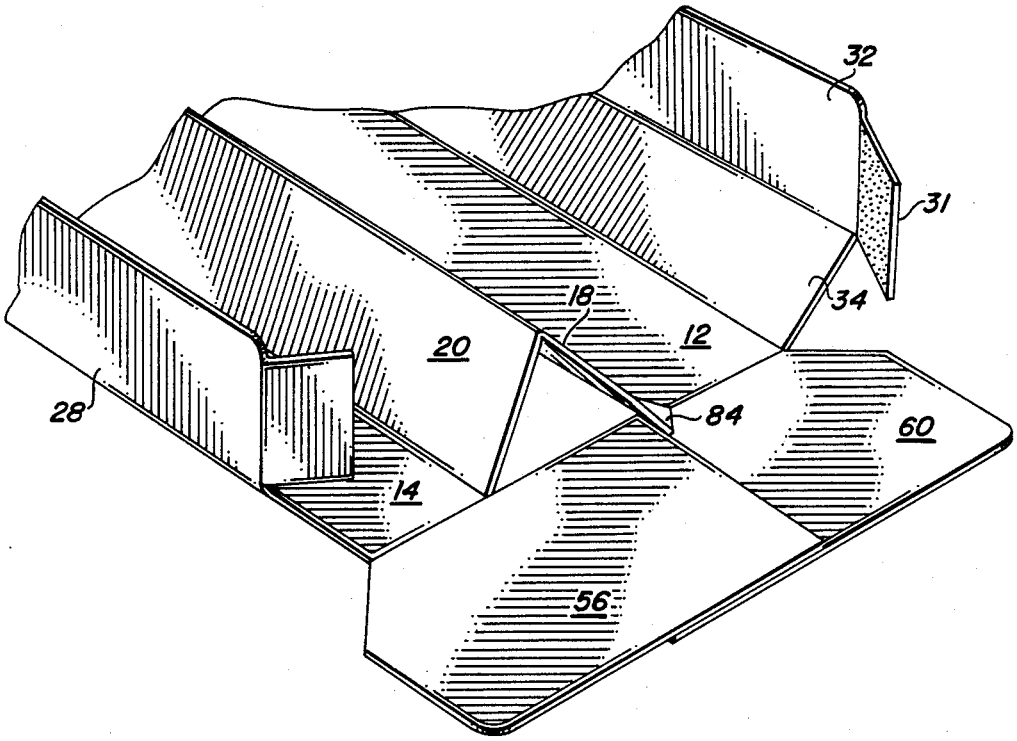
FIG. 5B is an enlarged pictorial view of the same portion of the blank of FIG. 2 after the initial folding step.

Continued upward folding of the divider section walls 18 and 20 causes continued relative sliding movement between the flaps 56 and 60 until movement is stopped by the leading edge of the flap corner area 96 encountering the inside face of the web 84 adjacent the fold line 88. This condition is shown in FIG. 5B, which corresponds to the condition of the blank illustrated in FIG. 4. The desired angle of the divider walls is thereby determined by the automatic stopping of further movement of the flap 56, which prevents further folding of the divider walls 18 and 20 and allows the angle reached by the divider walls at the time the web is contacted to be maintained. The same action is of course occurring at the web 82 to stop movement of the flap 54. Although webs are not necessarily required on both sides of the blank in order to stop further sliding movement of both flaps 54 and 56, it is preferred that both be provided in order to prevent any misalignment of the flaps and the possible resulting tilting or skewing of the divider.

Figure 6:
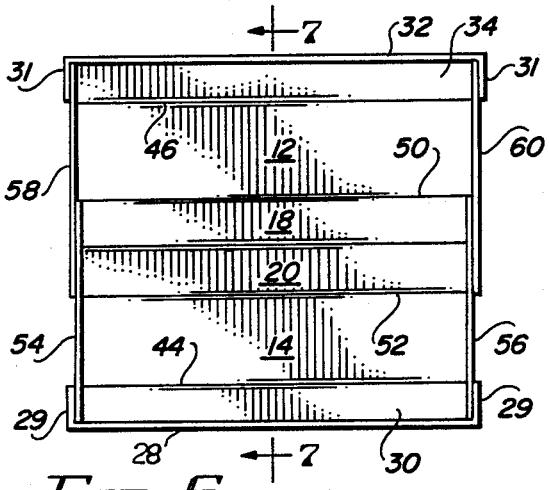
FIG. 6 is a plan view of the tray of FIG. 1.
Figure 7:
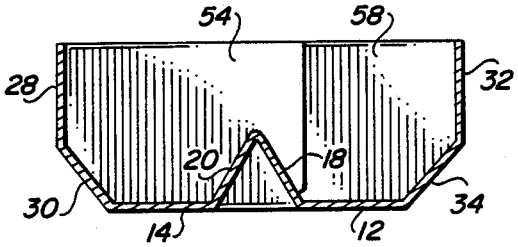
FIG. 7 is a transverse sectional view taken along line 7—7 of FIG. 6.
Figure 8:
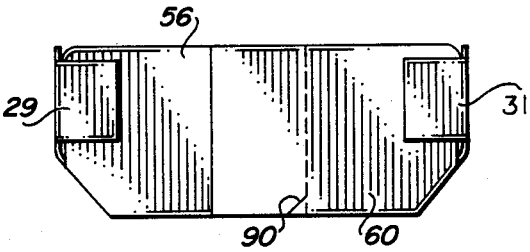
FIG. 8 is an end elevation of the tray of FIG. 1.
Figure 9:
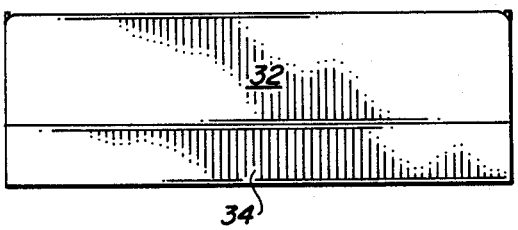
FIG. 9 is a side elevation of the tray of FIG. 1.

Referring back to FIG. 4, the next step in the fabrication of the tray is to apply adhesive to the glue tabs 29 and 31 as shown by the stippling. The connected flaps 54 and 58 and the connected flaps 56 and 60 are then folded up along fold lines 66, 70 and 68, 72, respectively, after which the side panels 32, 34, 28 and 30 are folded upwardly about their fold lines 42, 46, 44 and 48. This folding action continues until the side panel sections 32 and 28 are in a vertical position so that the glue tabs can be folded over the adjacent end wall flaps 54, 56, 58 and 60. This results in the blank being formed into the final tray shape shown in FIG. 6.

As shown in FIGS. 6, 7, 8 and 9, as well as FIG. 1, the resulting tray is held in place simply by the adhered overlapping end flaps and by the glue tabs extending from the side panel sections 28 and 32. Just as the automatic positioning of the inner and outer end flaps with respect to each other determines the final angle which the divider walls 18 and 20 form with the bottom panel portions 12 and 14, the upward folding of the upper side panel sections 28 and 32 to the vertical determines the angle formed by the sloped side panel portions 30 and 34 with the bottom panel portions. By proper selection of dimensions, these angles can be varied as dictated by the shape of the product to be supported, and can be made equal to each other.

It is to be understood that although the term "fold line" has been used in connection with all of the lines in the blank along which the paperboard is intended to be folded, some of the fold lines may be made more pliable and easier to fold about than others. For example, the fold lines 22, 50 and 52 should preferably be easier to fold than the other parallel fold lines in the main body of the blank so that when forces are exerted on the blank to cause relative sliding movement of the end flaps, these fold lines will yield and allow the formation of the center divider. Accordingly, it may be desirable to form the fold lines 42, 44, 46 and 48 from relatively stiff score lines rather than relatively yielding fold lines.

Although the tray has been described as being held in place by glued connections, it will be understood that mechanical locks could be utilized instead. Glued connections are preferred, however, because they allow a smoother, sleeker appearance uninterrupted by bulky mechanical locks, and they also allow speedier assembly of the trays. Moreover, trays formed from glued connections are not as likely to come apart or tear due to excessive handling or shipping stresses as are trays formed with mechanical locks.

It will now be appreciated that the tray of the present invention is simple to form from the disclosed blank and that it will function to suitably support fragile articles such as cookies. The angled walls of the center divider and the sloped portions of the side panels support the articles along substantial portions of their circumference, while the vertical end panels and the vertical portions of the side panels protect the rows of articles against forces coming from the side or end of the package.

It should also be understood that the invention is not necessarily limited to all the specific details described in connection with the preferred embodiment, but that changes to certain features of the preferred embodiment which do not affect the overall basic function and concept of the invention may be made by those skilled in the art without departing from the spirit and scope of the invention, as defined in the appended claims.

What is claimed is:

1. A paperboard tray for holding a plurality of rows of aligned articles, comprising:

a bottom panel comprising spaced bottom panel portions, each bottom panel portion having end edges, an outer side edge and an inner side edge;

end panels connected by fold lines to the end edges of the bottom panel portions;

side panels connected by fold lines to the outer side edges of the spaced bottom panel portions;

divider means located between the bottom panel portions and extending substantially parallel to the side panels;

the divider means including sloped walls connected by fold lines to the inner side edges of the spaced bottom panel portions, the sloped walls forming obtuse angles with their associated bottom panel portions;

the bottom panel portions, the divider means, and the side panels comprising channel means adapted to receive and support rows of articles;

each end panel being comprised of overlapping inner and outer end panel flaps connected to adjacent ends of the side panels, means connecting associated overlapping inner and outer end panel flaps to each other; and means providing a stop engaging an inner side edge of the inner end panel flap for causing the inner end panel flap to be correctly positioned with respect to the outer end panel flap.

2. A paperboard tray according to claim 1, wherein the means providing a stop engaging an inner edge of the inner end panel flap comprises a web extending from an adjacent end edge of an adjacent sloped divider wall into the outer end panel flap.

3. A paperboard tray according to claim 2, wherein each side panel comprises a sloped portion connected to the outer side edge of an adjacent bottom panel portion and forming an obtuse angle with the adjacent bottom panel portion, the sloped walls of the divider means and the sloped portions of the side panels comprising support surfaces in the channel means, the channel means and the support surfaces being adapted to receive and support substantially flat rounded- edge articles.

4. A paperboard tray according to claim 2, wherein the means connecting the associated overlapping inner and outer end panel flaps to each other comprises glue means.

5. A paperboard blank for forming a tray for holding a plurality of rows of aligned articles, comprising:

a bottom panel section comprising spaced bottom panel portions, each bottom panel portion having end edges, an outer side edge and an inner side edge;

end panel sections connected by fold lines to the end edges of the bottom panel portions;

side panel sections connected by fold lines to the outer side edges of the spaced bottom panel portions;

divider means located between the spaced bottom panel portions and extending substantially parallel to the side panel sections;

the divider means including wall portions connected by fold lines to the inner side edges of the spaced bottom panel portions, the divider wall portions forming obtuse angles with their associated bottom panel portions in a tray formed from the blank;

the bottom panel portions of a tray formed from the blank between the divider means and the side panels comprising channel means adapted to receive and support rows of articles;

each end panel section being comprised of a pair of end panel flaps comprising an outer end panel flap and an inner end panel flap, each flap connected by a fold line to an end edge of one of the spaced bottom panel portions, the outer end panel flap being adapted to overlap a portion of the inner end panel flap; and means associated with the outer end panel flap providing a stop for engaging an inner side edge of the inner end panel flap to cause the inner end panel flap to be correctly positioned during the forming of a tray from the blank.

6. A paperboard blank according to claim 5, wherein each side panel section includes an outer portion and an inner portion, the outer portion being connected to the inner portion along a fold line, the outer portion forming an upper substantially vertical side panel portion in a tray formed from the blank and the inner portion forming a lower sloped portion in a tray formed from the blank, the bottom panel portions being connected to the lower sloped side panel portions in a tray formed from the blank and forming obtuse angles therewith.

7. A paperboard blank according to claim 6, including a fold line connecting the wall portions of the divider means to each other and extending substantially parallel to the side panel sections of the tray.

8. A paperboard blank according to claim 5, wherein the means associated with the outer end panel flap for providing a stop for engaging an inner side edge of the inner end panel flap comprises a web extending from an adjacent end edge of an adjacent divider wall portion into the outer end panel flap.

9. A paperboard blank according to claim 8, wherein the web is connected to the outer end panel flap along a fold line which is an extension of the fold line connecting the adjacent divider wall portion to the inner side edge of the associated bottom panel portion.

10. A paperboard blank according to claim 9, wherein the web is connected to the adjacent end edge of the adjacent divider wall portion along a fold line.

11. A paperboard blank according to claim 10, wherein the end edge of the divider wall portion is aligned with the fold lines connecting the end panel flaps to the spaced bottom panel portions.

* * * * *